US005351946A

United States Patent [19]

Kamoda et al.

[11] Patent Number: 5,351,946

[45] Date of Patent: Oct. 4, 1994

[54] DELIVERY APPARATUS FOR SHEET-FED PRINTING PRESS

[75] Inventors: Hiroyoshi Kamoda; Reiji Itoh, both of Ibaragi Toride, Japan

[73] Assignee: Komori Corporation, Tokyo, Japan

[21] Appl. No.: 153,748

[22] Filed: Nov. 17, 1993

[30] Foreign Application Priority Data

Nov. 26, 1992 [JP] Japan ..... 4-086840

[51] Int. Cl.[5] ..... B65H 29/04

[52] U.S. Cl. ..... 271/206; 271/204; 198/477.1

[58] Field of Search ..... 271/204, 206, 268, 277; 198/477.1, 483.1

[56] References Cited

U.S. PATENT DOCUMENTS 4,205,606 6/1980 Jiruse ..... 271/206 X
5,172,802 12/1992 Wells ..... 198/477.1 X
5,244,078 9/1993 Silva et al. ..... 198/477.1 X

FOREIGN PATENT DOCUMENTS 0141664 5/1980 Fed. Rep. of Germany ..... 271/206
58-167348 10/1983 Japan .
63-161253 10/1988 Japan .
0282041 11/1988 Japan ..... 271/204
4-5452 7/1992 Japan .

*Primary Examiner*—H. Grant Skaggs
*Assistant Examiner*—Carol L. Druzbick
*Attorney, Agent, or Firm*—Blakely, Sokoloff, Taylor & Zafman

[57] ABSTRACT

A delivery apparatus for a sheet-fed printing press includes a holding member, a delivery chain, at least two sheet stacking units, an engaging member, and a switching unit. The switching unit selectively switches a sheet release position where the engaging member abuts against the holding member and a retreat position where the engaging member does not abut against the holding member. The switching unit includes an air cylinder having a movable actuating rod, a first lever, having two ends pivotally mounted on the actuating rod and the engaging member, respectively, for coupling the actuating member and the engaging member, and a second lever having one end swingably supported and the other end swingably and pivotally mounted on a coupling portion between the actuating rod and the first lever. The first and second levers are located substantially on a straight line when the engaging member is at the sheet release position.

8 Claims, 3 Drawing Sheets

DELIVERY APPARATUS FOR SHEET-FED PRINTING PRESS

BACKGROUND OF THE INVENTION

The present invention relates to a multi-pile type delivery apparatus for a sheet-fed printing press, which alternately deliveries printed and conveyed paper sheets to a plurality of sheet stacking units lined up in a sheet convey direction.

Generally, in a sheet-fed printing press, a paper sheet printed by a printing press is transferred from the grippers of a printing cylinder to the delivery grippers of delivery chains, and conveyed as the delivery chains travel. When the delivery grippers holding the paper sheet abuts against the sheet release cam at the convey end portion, the paper sheet is released from the delivery grippers, falls and is stacked on the pile of the delivery apparatus. Conventionally, a multi-pile type delivery apparatus is proposed in which a plurality of sheet stacking units, i.e., piles are lined up in the sheet convey direction. For this reason, when the number of paper sheets stacked on the pile reaches a predetermined number, the printing press need not be stopped to change the pile. In this case, a sheet release cam is provided above each sheet stacking unit. A cam switching means is provided in correspondence with each sheet release cam except for the most downstream cam to individually move the sheet release cam between a sheet release position where the sheet release cam abuts against the delivery grippers to cause the paper sheet to be released and a retreat position where the sheet release cam retreats not to abut against the delivery grippers. An adjusting unit for moving and adjusting the position of the sheet release cam is provided to each sheet release cam. The adjusting unit selects an optimum sheet release position and an optimal sheet release timing in accordance with the printing speed, the sheet size, the sheet thickness, or the sheet material, thereby preventing sheet misalignment or sheet jamming in the delivery unit.

Sheet-fed printing presses having such a cam switching means or movement adjusting units for a sheet release cam are disclosed in Japanese Utility Model Laid-Open Nos. 63-161253 and 4-5452, and Japanese Patent Laid-Open No. 58-167348. However, the movement adjusting unit of the sheet release cam disclosed in Japanese Utility Model Laid-Open No. 63-161253 has a structure in which the swinging fulcrum of the sheet release cam is free to shift inside an elongated hole, one end of a lever swingably supported at the central portion is pivotally mounted on the sheet release cam, and the other end is coupled to a piston rod. When the piston rod is moved, the swinging fulcrum of the sheet release cam is shifted inside the elongated hole, and at the same time, the sheet release cam is pivoted about the swinging fulcrum. For this reason, the sheet release cam is nonlinearly moved to make it difficult to correctly adjust the position, and when a cam follower abuts against the cam, the lever directly applies a load on the piston rod. The cam switching means disclosed in Japanese Utility Model Laid-Open No. 4-5452 has a structure in which the cam is vertically escaped with respect to the traveling direction of the cam follower. For this reason, when the printing speed is increased, it becomes difficult to set the timing of cam switching. In the worst case, the cam strikes the cam follower from the side to damage the printing press. The cam switching means disclosed in Japanese Patent Laid-Open No. 58-167348 has a structure in which one end and the other end of the lever swingably supported are simply coupled with the piston rod and the sheet release cam, respectively. For this reason, when the cam follower abuts against the cam, the lever directly applies the load on the piston rod.

SUMMARY OF THE INVENTION

It is an object of the present invention to provide a delivery apparatus for a sheet-fed printing press, which prevents the damage or the failure of a driving source for sheet conveyance.

It is another object of the present invention to provide a delivery apparatus for a sheet-fed printing press, capable of easily adjusting a sheet release timing.

In order to achieve the above objects, there is provided a delivery apparatus for a sheet-fed printing press, comprising a holding member for holding a printed paper sheet, conveying means for causing the holding member to travel to convey the held paper sheet, at least two sheet stacking units respectively arranged on upstream and downstream sides of a sheet convey direction of the conveying means, an engaging member, arranged above the sheet stacking unit on the upstream side, for releasing the held paper sheet by abutting against the traveling holding member, and switching means for selectively switching a sheet release position where the engaging member abuts against the holding member and a retreat position where the engaging member does not abut against the holding member, the switching means including driving means having a movable actuating rod, a first lever, having two ends pivotally mounted on the actuating rod and the engaging member, respectively, for coupling the actuating member and the engaging member, and a second lever having one end swingably supported and the other end swingably and pivotally mounted on a coupling portion between the actuating rod and the first lever, so that the first and second levers are located substantially on a straight line when the engaging member is at the sheet release position.

DESCRIPTION OF THE PREFERRED EMBODIMENT

Figure 1:
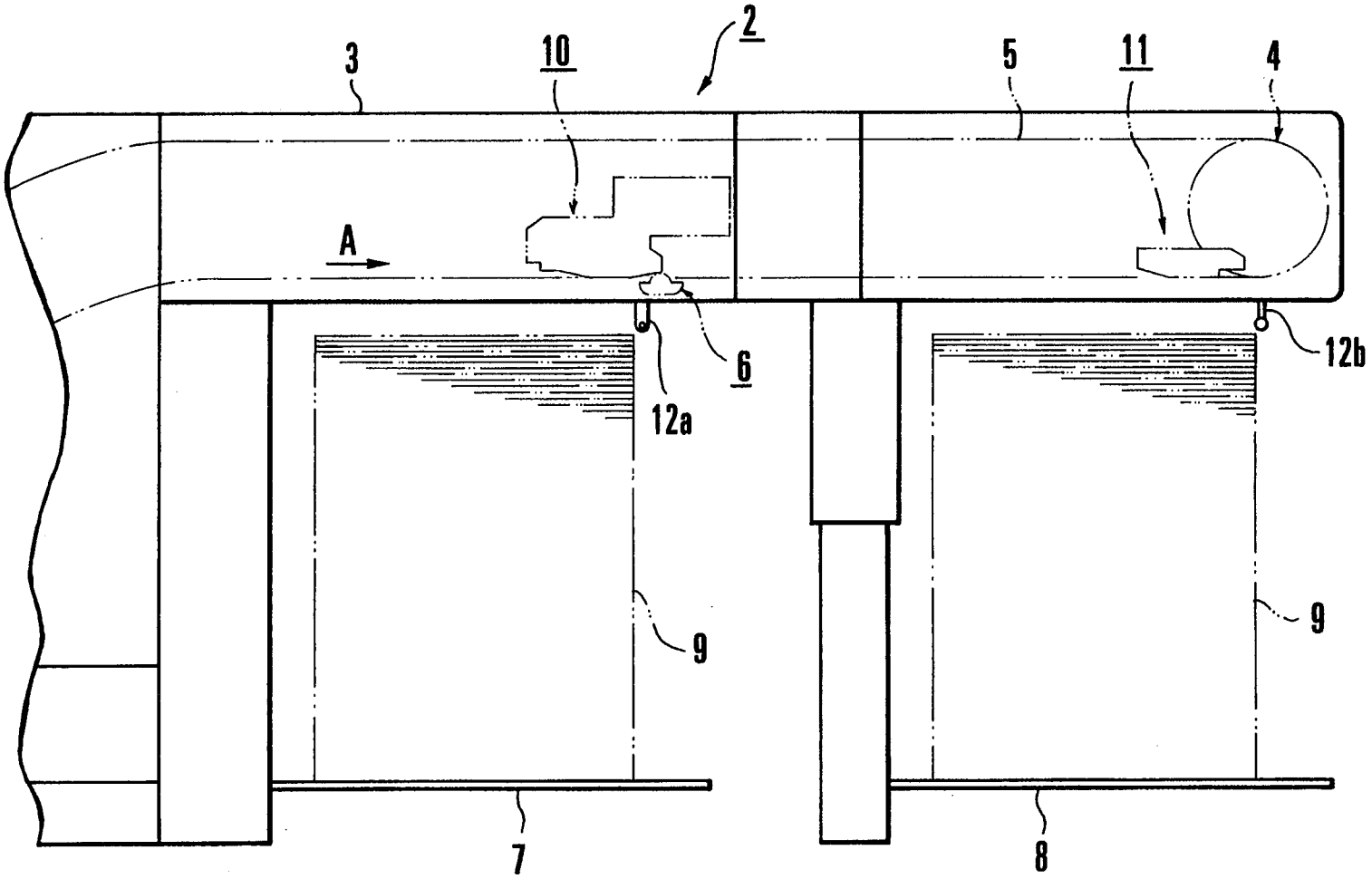
FIG. 1 is a schematic front view showing a delivery apparatus for a sheet-fed printing press according to an embodiment of the present invention.
Figure 2:
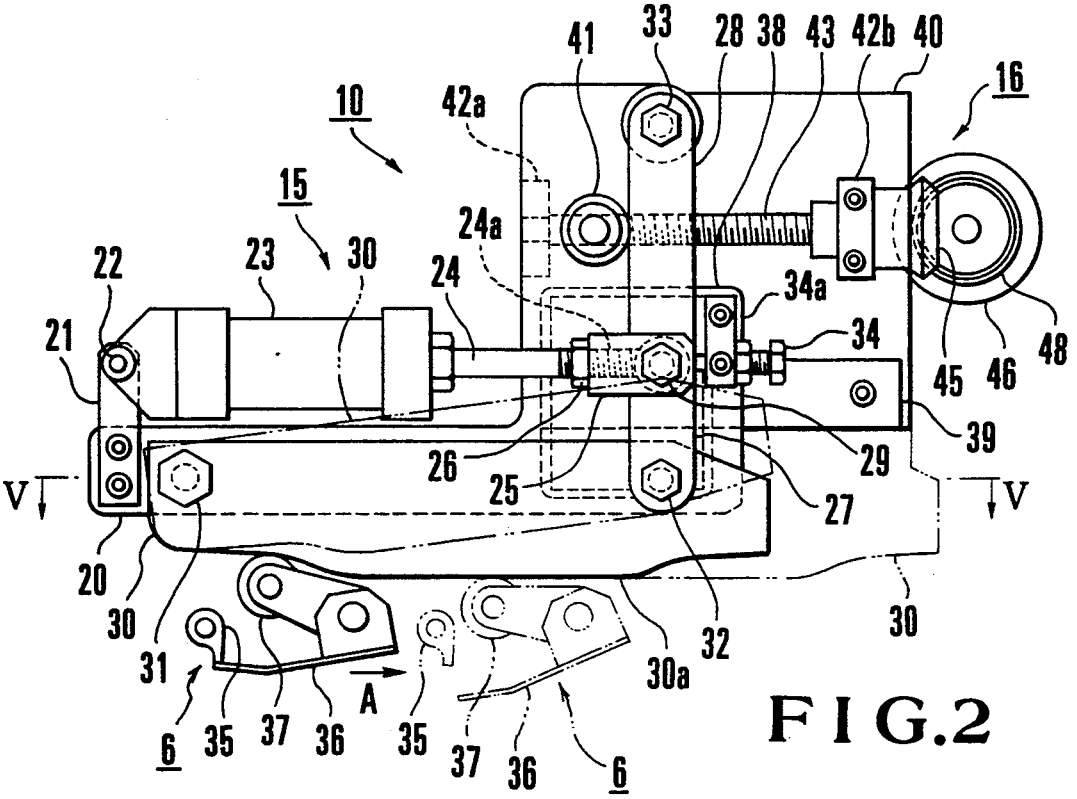
FIG. 2 is a front view showing a structure of a sheet release mechanism in FIG. 1.

An embodiment of the present invention will be described below with reference to the accompanying drawings. FIG. 1 shows a delivery apparatus for a printing press according to the present invention, FIGS. 2, 3, 4, and 5 show a sheet release mechanism in FIG. 1. Referring to FIG. 1, a delivery apparatus 2 comprises a pair of left and right delivery frames 3. A pair of left and right sprockets 4 are axially mounted on the rear ends of the upper end portions of the delivery frames 3, i.e., the terminal ends in the sheet convey direction, respectively. Sprockets (neither are shown) corresponding to the sprockets 4 are coaxially provided to a delivery cylinder (not shown) in contact with the last printing cylinder of the printing unit connected with the delivery apparatus. A pair of left and right delivery chains 5 respectively extend between the sprockets along upper and lower chain guides (neither are shown), and travel in a direction indicated by an arrow A in FIG. 1 by the sprockets rotated by a motor.

Delivery gripper members 6 for gripping and conveying the paper sheets are supported between the left and right delivery chains 5 at predetermined intervals. Reference numerals 7 and 8 denote first and second piles 7 and 8, respectively, which are lined up in the traveling direction of the delivery chains, i.e., in the sheet convey direction. Sheet release mechanisms 10 and 11 are disposed above the first and second piles 7 and 8, respectively. A cam switching means 15 to be described later is provided to the sheet release mechanism 10 above the first pile 7. The cam switching means 15 selectively operates the sheet release mechanism 10 to cause the traveling delivery gripper member 6 to release a gripped paper sheet 9 to be fallen and stacked on the first pile 7, or cause the delivery gripper member 6 to pass while keeping the paper sheet 9 gripped. The sheet release mechanism 11 comprising a fixed cam is disposed above the second pile 8. The delivery gripper member 6 passing over the first pile 7 abuts against the fixed cam of the sheet release mechanism 11. When the paper sheet 9 is gripped by the delivery gripper member 6 passing over the first pile 7, the paper sheet 9 falls and is stacked on the second pile 8. First and second front gauges 12*a* and 12*b* are disposed near the upper rear end portions of the first and second piles 7 and 8, respectively. The leading end of the paper sheet 9 released from the delivery gripper member 6 abuts against the front gauge 12*a* or 12*b*, and fallen onto the first or second pile 7 or 8. Vertically movable sheet stacking plates (neither are shown) for stacking paper sheets 9 thereon are provided to the first and second piles 7 and 8, respectively.

The sheet release mechanism 10 as a feature of the present invention will be described below in detail with reference to FIGS. 2 to 5. The sheet release mechanism 10 is schematically constituted by the cam switching means 15 and a cam moving means 16. The cam switching means will be described first. Reference numeral 20 denotes an elongated base plate vertically disposed with its longitudinal direction being arranged in parallel to the sheet convey direction. An air cylinder 23, a first lever 27, a second lever 28, and a cam 30, all of which constitute the cam switching means 15, are mounted on the base plate 20. More specifically, the air cylinder 23 is arranged in parallel to the base plate 20, and has one end pivotally supported, by a pin 22, on a plate 21 fixed by screws at the distal end portion of the base plate 20, and a screw portion 24*a* is formed at a piston rod 24 projecting from the air cylinder 23.

The bottom portion of a substantially U-shaped holder 25 is threadably engaged with the screw portion 24*a* and fixed by a nut 26 integrally with the piston rod 24. One end of the first lever 27 and one end of the second lever 28 are axially mounted between the arms of the holder 25 by a screw 29 so as to overlap each other and are coupled to the piston rod 24 through the holder 25. Reference numeral 30 denotes a sheet release cam 30 having, on its lower surface, a cam surface 30*a* against which a cam follower 37 of the delivery gripper member 6 to be described later abuts. The sheet release cam 30 has its one end axially mounted on the base plate 20 by a screw 31, and is free to swing about the screw 31.

The other end of the first lever 27 is axially mounted on and coupled to the other end of the sheet release cam 30 by a screw 32. The other end of the second lever 28 is axially mounted on the base plate 20 by a screw 33, and the second lever 28 is supported to be swingable about the screw 33. When the air cylinder 23 is operated to retreat the piston rod 24, the second lever 28 is pivoted clockwise about the screw 33. Accordingly, the first lever 27 is moved obliquely upward to cause the sheet release cam 30 to swing counterclockwise about the screw 31 and move to the retreat position indicated by a chain double-dashed line. On the other hand, when the piston rod 24 is moved forward, the second lever 28 is pivoted counterclockwise about the screw 33. Accordingly, the first lever 27 is moved obliquely downward to cause the sheet release cam 30 to pivot clockwise about the screw 31 and move to the sheet release position indicated by a solid line. When the sheet release cam 30 is at the sheet release position, the first and second levers 27 and 28 are located substantially on a straight line. Reference numeral 34 denotes a stopper threadably engaged with a block 34*a* fixed to the base plate 20, and has its distal end projecting from the block 34*a* in contact with the second lever 28.

The arrangement of the delivery gripper member 6 fixed to the delivery chain 5 will be described. The delivery gripper member 6 is constituted by disposing a gripper pad 35 and a gripper 36 to oppose each other, and a biasing force in a close direction to press the distal end of the gripper 36 against the gripper pad 35 is applied by a spring member (not shown). On the other land, the gripper 36 is separated from the gripper pad 35 against the applied biasing force when the cam follower 37 abuts against the cam surface 30*a* of the sheet release cam 30.

Figure 3:
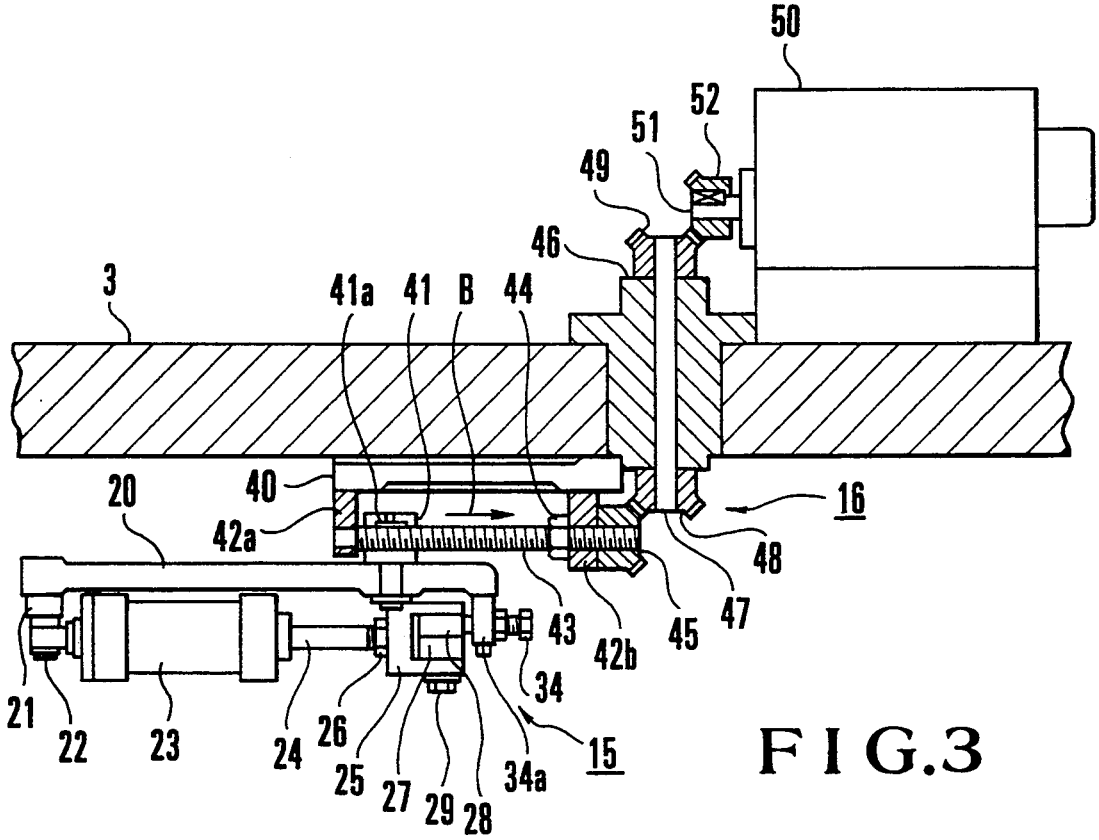
FIG. 3 is a plan view showing the structure of the sheet release mechanism in FIG. 1.
Figure 4:
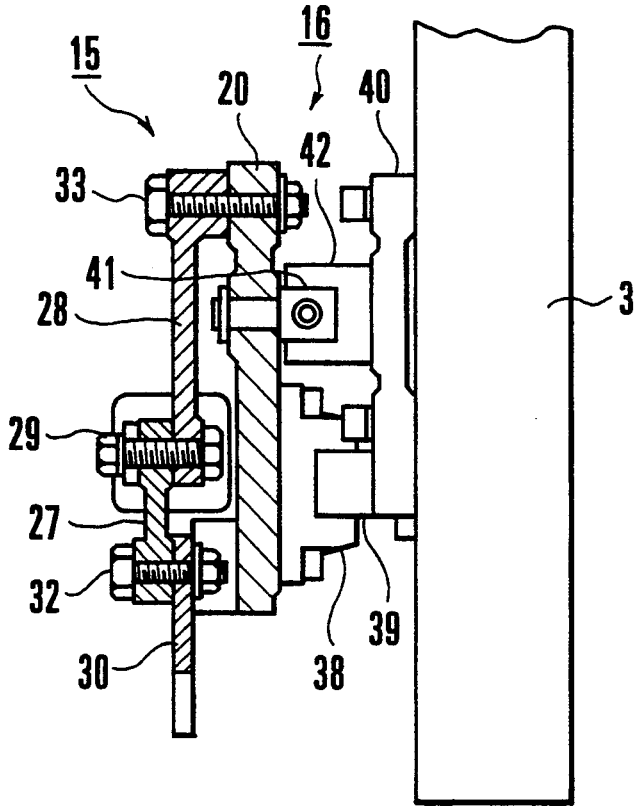
FIG. 4 is a side view showing the structure of the sheet release mechanism in FIG. 1.
Figure 5:
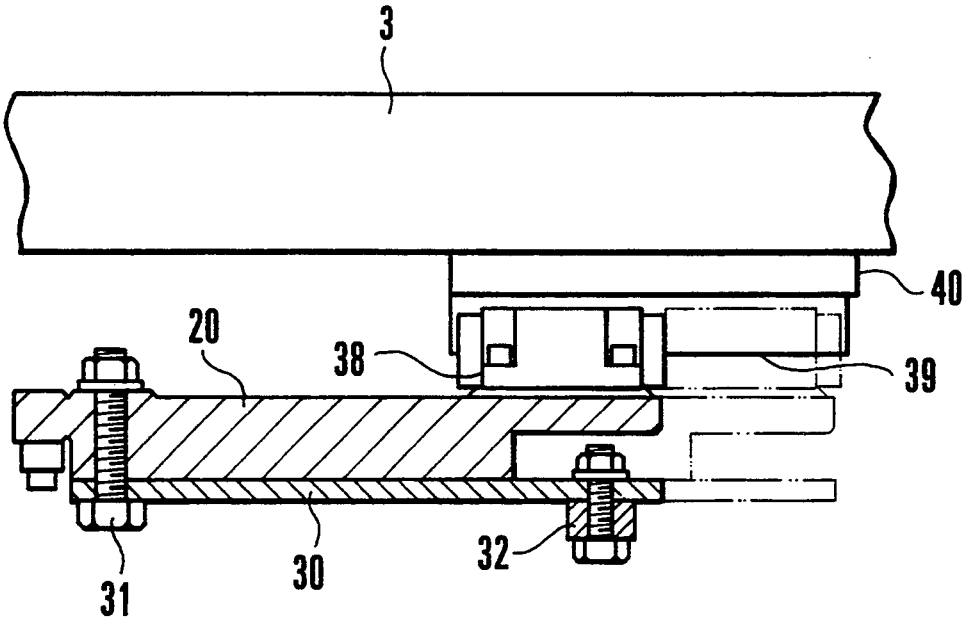
FIG. 5 is a sectional view taken along line V—V in FIG. 2.

The arrangement of the cam moving means 16 will be described. As shown in FIGS. 4 and 5, a sliding member 38 is mounted on one side surface of the base plate 20 to be free to linearly slide. On the other hand, a guide member 39 engaged with the sliding member 38 is mounted, in parallel to the traveling direction of the delivery gripper member 6, on a fixed plate 40 fixed on the frame 3. The base plate 20 is freely slid along the guide member 39 by the sliding member 38. As shown in FIG. 3, a pin 41 stands upright from one side surface of the base plate 20, and a screw portion 41*a* is formed to extend through a head portion of the pin 41 in the sliding direction of the guide member 39. A pair of bearing plates 42*a* and 42*b* are mounted on the fixed plate 40 to oppose each other. A screw rod 43 is rotatably supported by the bearing plates 42*a* and 42*b* to be parallel to the guide member 39. A step-like distal end of the screw rod 43 is stopped at the bearing plates 42*a* and the other end is stopped at the bearing plate 42*b* by a nut 44, so that the horizontal movement of the screw rod 43 is hindered. The screw rod 43 is threadably engaged with the screw portion 41*a* of the pin 41. A bevel gear 45 is fixed to the other end as the projecting portion of the screw rod 43.

A bearing sleeve 46 extends through the frame 3. A shaft 47 having a bevel gear 48 meshed with the bevel gear 45 at one end and a bevel gear 49 fixed at the other end is rotatably supported by the bearing sleeve 46. A bevel gear 52 fixed to a motor shaft 51 of a reversible motor 50 is meshed with the bevel gear 49.

An operation of the present invention having the above arrangement will be described below. The paper sheet 9 printed by a printing press (not shown) is transferred from the gripper of a printing cylinder to the gripper 36 and the gripper pad 35 of the delivery gripper member 6 of the delivery chains 5, and conveyed to the upper portion of the first pile 7 as the delivery chains 5 travel. If the paper sheets are stacked on the first pile 7, the air cylinder 23 of the sheet release mechanism 10 above the first pile 7 is operated to cause the piston rod 24 to move forward. The sheet release cam 30 is pivoted clockwise about the screw 31 and moved downward to the sheet release position indicated by the solid line in FIG. 2.

When the cam follower 37 of the delivery gripper member 6 traveling in the direction indicated by the arrow A abuts against the cam surface 30*a* of the cam 30, the gripper 36 is pivoted in the open direction to cause the gripper 36 to release the paper sheet 9 to be fallen onto the first pile 7. At this time, when the cam follower 37 abuts against the cam surface 30*a*, an upward external force is applied to the cam 30, so that the sheet release cam 30 receives a counterclockwise load to pivot about the screw 31. However, since the first and second levers 27 and 28 are located substantially on a straight line, no force component is generated from the applied load in the moving direction of the piston rod 24. Therefore, no actual load is applied to the piston rod 24 to prevent damage to the air cylinder 23.

On the other hand, if the paper sheets are stacked on the second pile 8, the air cylinder 23 of the sheet release mechanism 10 above the first pile 7 is operated to retreat the piston rod 24. The sheet release cam 30 is pivoted counterclockwise about the screw 31 and moved upward to the retreat position indicated by the chain double-dashed line. The traveling cam follower 37 does not abut against the cam surface 30*a* of the cam 30, so that the paper sheet passes over the first pile 7 while being gripped by the gripper 36. When the cam follower 37 abuts against the fixed cam of the sheet release mechanism 11 above the second pile 8, the paper sheet 9 is released from the gripper 36 and fallen onto the second pile 8.

An adjusting operation of the opening/closing timing of the gripper 36 in the traveling direction of the delivery gripper member 6 will be described below. When the motor is rotated, the rotation of the motor 50 is transmitted from the motor shaft 51 to the shaft 47 through the bevel gears 52 and 49, and further to the screw rod 43 through the bevel gears 48 and 45. When the screw rod 43 is rotated, the pin 41 threadably engaged with the screw rod 43 is moved in a direction indicated by an arrow B in FIG. 3. The base plate 20 integral with the pin 41 is slid in the direction indicated by the arrow B along the guide member 39 fitted in the sliding member 38. Accordingly, the cam 30 mounted on the base plate 20 is also moved in the direction indicated by the arrow B, i.e., in parallel to the traveling direction of the delivery gripper member 6, thereby adjusting the position of the cam 30, i.e., the opening/-closing timing of the gripper 36. When the motor is reversely rotated, the base plate 20 is slid in a direction opposite to that of the arrow B, and the cam 30 is also moved in the same manner as described above.

As described above, since the cam 30 is linearly moved in parallel to the traveling direction of the delivery gripper member 6, the moving amount of the cam 30 is equivalent to the adjusting amount of the opening/closing position of the gripper 36. Therefore, the adjusting amount can be easily grasped and correctly adjusted. In this case, if a stepping motor or the like is used as the motor 50 to electrically measure and control the pivot amount of the motor shaft, the moving amount of the cam 30 can be correctly and easily controlled. Since the air cylinder 23, the first and second levers 27 and 28, and the cam 30 are mounted on the moving base plate 20, the relative positions among these members are not changed when the base plate 20 is moved. The positional relationship between the swinging position of the cam 30 swung by the switching means 15 and the delivery gripper member 6 is always constant. For this reason, the sheet gripping/releasing operation of the delivery gripper member 6 becomes stable, and at the same time, an erroneous operation can be prevented. If a detection mechanism for detecting the printing speed, the sheet size, the sheet thickness, or the sheet material is provided to the cam moving means 16, the sheet release cam 30 can be automatically moved to an optimum position by using a signal from the detection mechanism.

Although, in this embodiment, the present invention is applied to a delivery apparatus having two delivery piles, it may be used to a delivery apparatus laving three or more delivery piles. In addition, the cam switching means 15 may be operated by a pile switching signal generated when a predetermined number of paper sheets are stacked on one of delivery piles. Further, the cam switching means 15 may be operated by a signal from a known detection unit for detecting a defective paper sheet, thereby delivering the defective paper sheet onto a predetermined erroneous paper sheet delivery pile.

As has been described above, in the delivery apparatus for a sheet-fed printing press according to the present invention, when the paper sheet is released from the delivery gripper member by the sheet release cam, the sheet release cam receives a load from the delivery gripper member. However, no force component is generated in the direction of the actuating rod of the drive source while only the first and second levers located substantially on a straight line are loaded. For this reason, the drive source for swinging the sheet release cam receives no load, thereby preventing the damage or failure of the drive source.

What is claimed is:

1. A delivery apparatus for a sheet-fed printing press, comprising:

a holding member for holding a printed paper sheet;

conveying means for causing said holding member to travel to convey the held paper sheet;

at least two sheet stacking units respectively arranged at upstream and downstream portions along a sheet convey direction of said conveying means;

an engaging member, arranged above said sheet stacking unit at the upstream portion, for releasing the held paper sheet by abutting against said traveling holding member; and switching means for selectively switching said engaging member between a sheet release position where said engaging member abuts against said holding member and a retreat position where said engaging member does not abut against said holding member, said switching means including driving means having a movable actuating rod, a first lever, having two ends pivotally mounted on said actuating rod and said engaging member, respectively, for coupling said actuating member and said engaging member, and a second lever having one end swingably supported and the other end swingably and pivotally mounted on a coupling portion between said actuating rod and said first lever, so that said first and second levers are located substantially on a straight line when said engaging member is at the sheet release position.

2. An apparatus according to claim 1, wherein said switching means switches said engaging member through said first and second levers to the sheet release position when said actuating rod is moved forward, and to the retreat position when said actuating rod is retreated.

3. An apparatus according to claim 1, wherein said engaging member comprises a cam having a swinging end pivotally mounted on one end of said first lever to be vertically swung and a cam surface having a lower surface against which said holding member abuts, so that when said actuating rod is moved forward, said cam is swung to the sheet release position to cause said cam surface of said cam to move downward into a traveling track of said holding member, and when said actuating rod is retreated, said cam is swung to the retreat position to cause said cam surface of said cam to move upward out of the traveling track of said holding member.

4. An apparatus according to claim 1, wherein said holding member comprises a gripper, biased in a direction to grip the paper sheet, for engaging with said engaging member to be opened, and when said gripper of said holding member gripping the paper sheet is opened, the paper sheet falls and is stacked on said sheet stacking unit on the upstream side.

5. An apparatus according to claim 1, further comprising a base plate on which said engaging member and said switching means are integrally mounted, and moving means for linearly moving said base plate in the sheet convey direction, thereby adjusting a sheet release timing of said holding means.

6. An apparatus according to claim 5, wherein said moving means comprises a guide member mounted on a frame in parallel to the sheet convey direction, and a sliding member, mounted on said base plate, for engaging with said guide member to freely slide said base plate.

7. An apparatus according to claim 1, wherein a plurality of said sheet stacking units are arranged at the upstream portion, and a pair of said engaging member and said switching means are arranged in correspondence with each of said plurality of said sheet stacking units at the upstream portion.

8. An apparatus according to claim 1, further comprising a fixed cam, arranged above said sheet stacking unit at the downstream portion, for releasing the held paper sheet when said traveling holding member abuts against said fixed cam, so that said holding member which does not abut against said engaging member arranged above said sheet stacking unit at the upstream portion releases the held paper sheet when said holding member abuts against said fixed cam.

* * * * *